US005199224A

United States Patent [19]

Aluotto

[11] Patent Number: 5,199,224

[45] Date of Patent: Apr. 6, 1993

[54] DART SHARPENER

[76] Inventor: Peter A. Aluotto, 1668 Hendrickson St., Brooklyn, N.Y. 11234

[21] Appl. No.: 919,719

[22] Filed: Jul. 24, 1992

[51] Int. Cl.[5] ..... B24B 19/16

[52] U.S. Cl. ..... 51/157; 51/161; 51/214; 51/232

[58] Field of Search ..... 51/157, 161, 158, 156, 51/151, 154, 211 R, 211 H, 214, 216 T, 217 A, 232, 181 R, 205 R, 205 WG; 144/28.1

[56] References Cited

U.S. PATENT DOCUMENTS

| | | | |
|---|---|---|---|
| 426,716 | 4/1890 | Drake | 51/157 |
| 431,517 | 7/1890 | Harker | 51/157 |
| 478,608 | 7/1892 | Keist | 51/211 R |
| 547,151 | 10/1895 | Moseley | 51/157 |
| 740,962 | 10/1903 | Wilcox | 144/28.1 |
| 1,411,713 | 4/1922 | Downing | 51/157 |

FOREIGN PATENT DOCUMENTS 0006542 of 1890 United Kingdom ..... 144/28.1

*Primary Examiner*—Robert A. Rose

*Attorney, Agent, or Firm*—Kane, Dalsimer, Sullivan, Kurucz, Levy, Eisele and Richard

[57] ABSTRACT

An apparatus for sharpening a dart includes a sharpening stone and a dart holder. The apparatus simultaneously translates the dart to be sharpened across the stone while rotating it against the stone in a direction opposed to the translation. An accurate, precision point, superior to any provided by hand sharpening, is imparted to on the dart because it is held, in the apparatus, at a constant angle with respect to the sharpening stone as it is being simultaneously rotated and translated thereacross.

11 Claims, 4 Drawing Sheets

FIG. 4
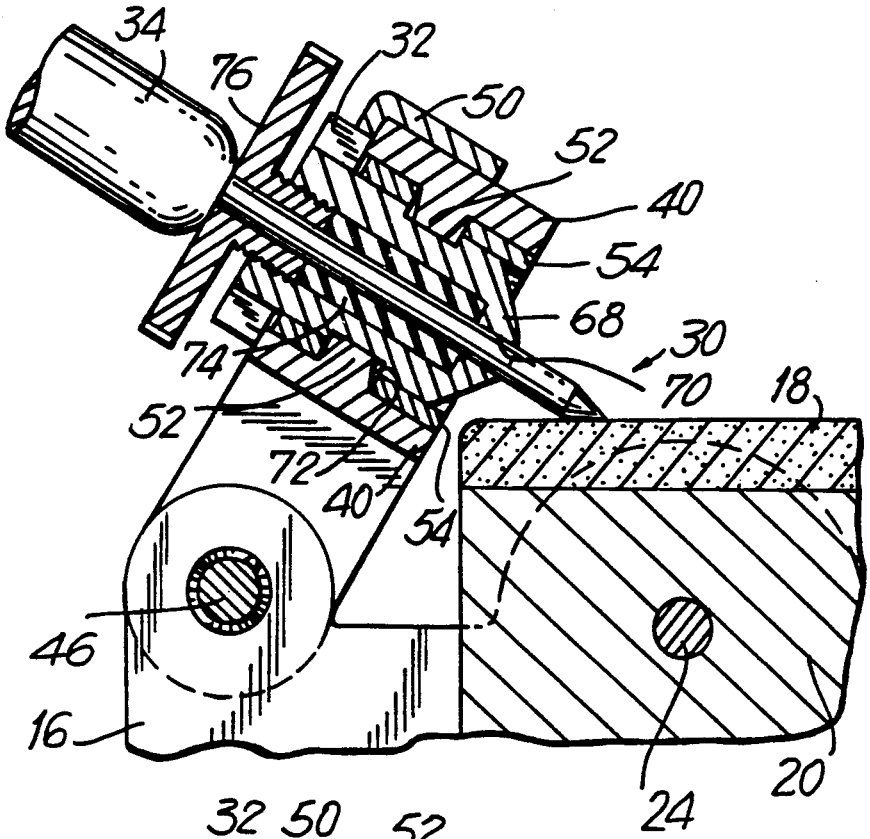
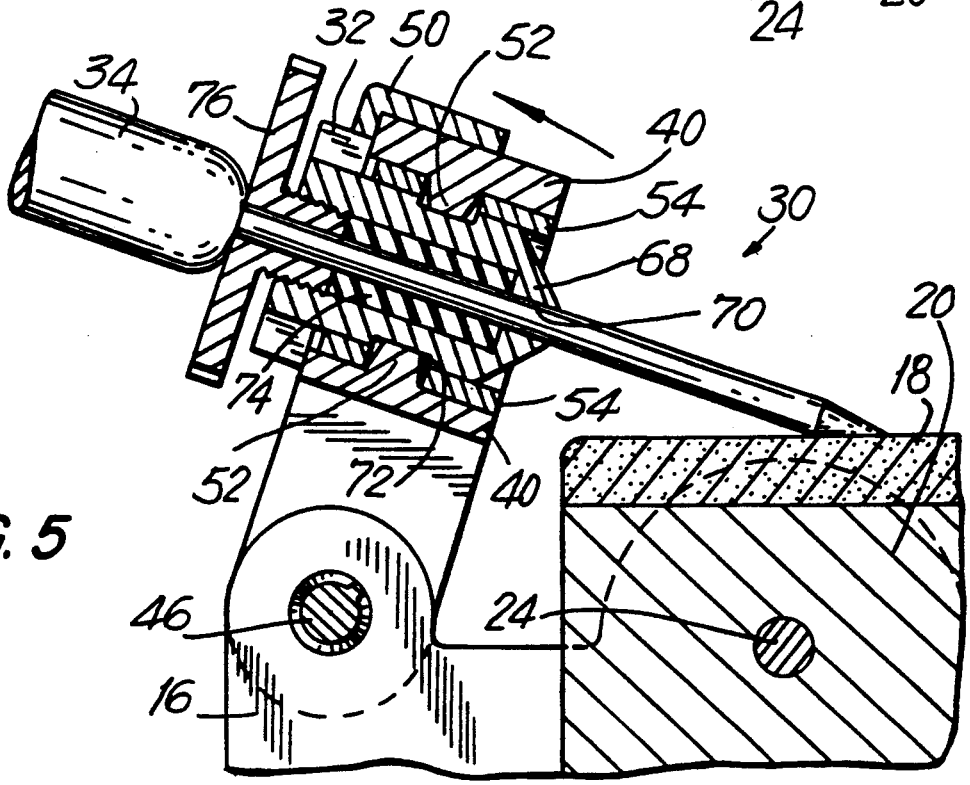
FIG. 5

DART SHARPENER

BACKGROUND OF THE INVENTION

1. Field of the Invention

The present invention relates to darts, those hand-propelled projectiles used in recreational target games, and, more specifically, to an apparatus which may be used to provide a dart with an accurate and precise point when, through use, it has become blunt or dull.

2. Description of the Prior Art

Dart games are well known in the art, and are a popular form of recreation in many countries around the world. Typically, those playing the game must stand behind a line a set distance from the target dart board, and throw darts, which are small arrow-like projectiles, into the board. Areas of the board have various numeral values. Depending on the game being played, the object may be to achieve the greatest score with a given number of throws, or to reach "zero" first and exactly, starting from some fixed score, such as "501".

In some dart boards, the pie-slice-shaped regions assigned different numerical values are separated from one another by wire. Inevitably, some darts will strike the wire, rather than the target itself, and will not penetrate into the target. Such darts will fall to the floor, and, because the point is the heaviest part of the dart, the air resistance on the lighter, plumed portion will cause them to hit the floor point first. This, as well as the errant throws of beginners, who may frequently miss the target entirely, causes an early dulling or blunting of the dart points.

In the prior art, the blunting of the dart points through use was addressed by sharpening with a hand-held sharpening stone. Typically, the user would hold the stone in the palm of one hand while honing the point of a dart against the stone with the other. While a dart may be sharpened in this fashion, it is not humanly possible to hold the point consistently against the stone at a fixed angle or to hone to the same degree completely around the point.

The present invention provides an apparatus which may be used to place an accurate, precision point on a dart superior in all respects to one obtainable by hand.

SUMMARY OF THE INVENTION

The present invention is a dart sharpening apparatus which enables the user to put an accurate, precision point onto a dart dulled or blunted through use. The apparatus comprises a substantially U-shaped frame used to dispose both a sharpening stone, and a means for simultaneously translating and rotating a firmly held dart at a predetermined angular orientation across the surface of the sharpening stone. The apparatus is designed to rotate the dart in a direction such that it is turned against the surface of the sharpening stone in a direction opposite to that in which it is being translated to render more effective the sharpening action thereagainst that occurs during each passage back and forth.

The present invention will now be described in more detail with frequent reference being made to the several drawing figures, which may be described as follows.

BRIEF DESCRIPTION OF THE DRAWINGS

FIG. 4 is a cross-sectional view of the dart sharpening apparatus taken as indicated by line 4—4 in FIG. 3.

FIG. 5 is a cross-sectional view analogous to that provided in FIG. 4, but including a dart with a longer shaft.

DETAILED DESCRIPTION OF THE PREFERRED EMBODIMENT

Figure 1:
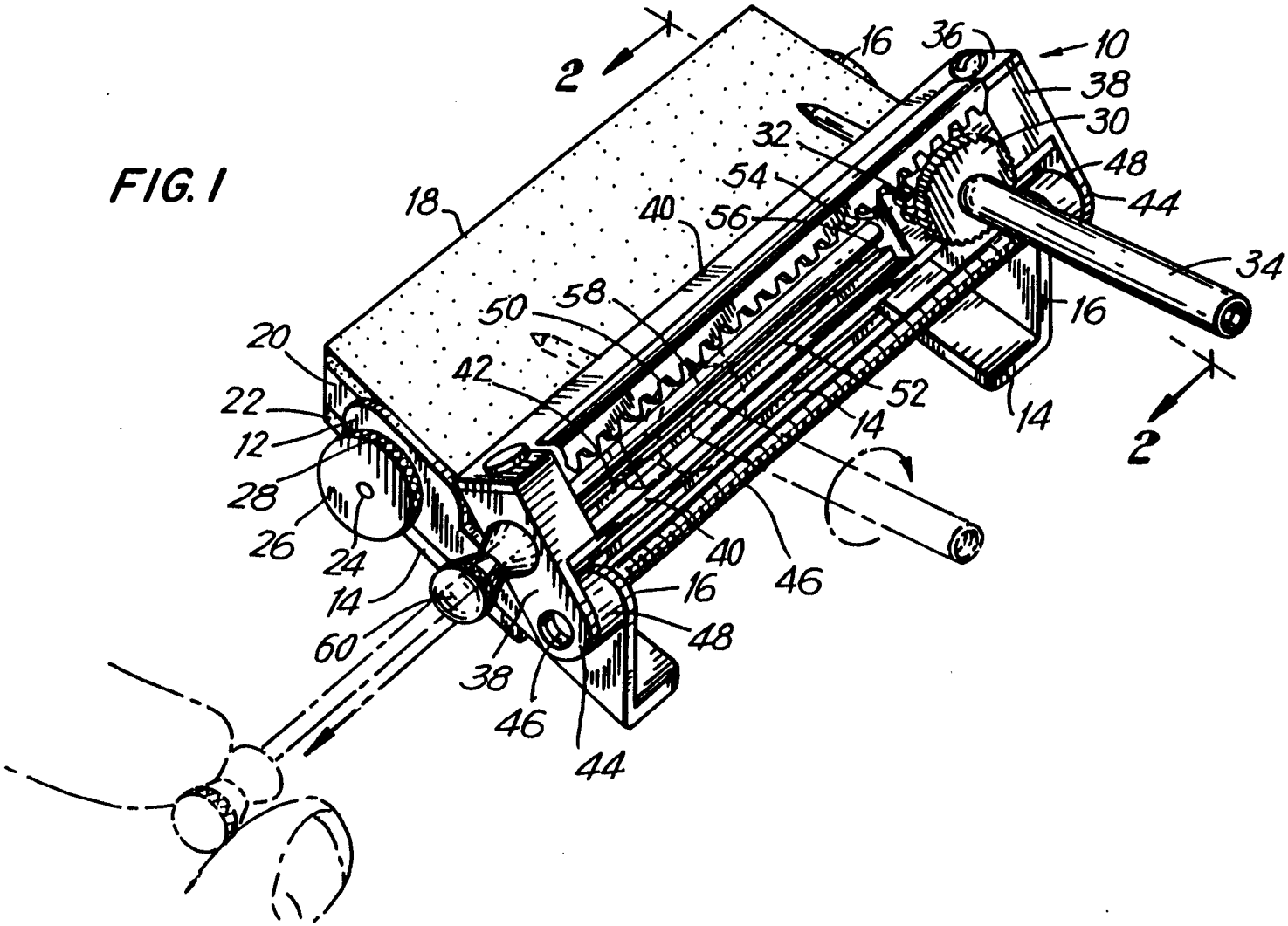
FIG. 1 shows a perspective view of the dart sharpening apparatus of the present invention.

FIG. 1 is a perspective view of the dart sharpening apparatus 10 of the present invention. The apparatus 10 comprises a substantially U-shaped frame 12 having a bottom portion 14 and two opposed upright portions 16.

A sharpening stone 18 is disposed between the two opposed upright portions 16 on a mounting block 20, which may be of wood. A second sharpening stone 22 may be disposed on another side of the mounting block 20, so that the apparatus 10 may be provided with two varieties of stone for use in sharpening darts having shafts of different metal. For example, a diamond stone may be provided on one side of the mounting block 20 for us in sharpening carbide darts or tungsten carbide darts. A soft stone, that is, a regular sharpening or honing stone, may be provided on another side of the mounting block 20 to sharpen high-speed steel or tempered steel darts.

The mounting block 20 may be disposed between the two opposed upright portions 16 of the substantially U-shaped frame 12 by passing a bolt 24 through one upright portion 16, axially through the mounting block 20, and through the other upright portion 16. A threaded knob 26 may be screwed onto the bolt 24 to secure the mounting block 20 between the two opposed upright portions 16 at a predetermined angular orientation. The threaded knob 26 may be provided with knurling 28 to facilitate its being manipulated by hand.

The above arrangement for disposing the sharpening stone 18 or stones 18,22 in the apparatus 10 is useful, in addition to enabling the user to set the sharpening stone 18 to a predetermined angular orientation, because it enables the user to face one or the other of the sharpening stones 18,22 upward for use in sharpening a dart by loosening knob 26 and by rotating mounting block 20 until the desired sharpening stone is in proper position for use. Further, the mounting block 20, with sharpening stone 18 or stones 18,22 attached, may be removed from its position between the two opposed upright portions 16 of the substantially U-shaped frame 12 and placed back therebetween in reversed orientation, so that the user may use the other sides of the stones 18,22 for sharpening when the original sides become worn and less effective.

Sharpening stone 18 and second sharpening stone 22 may advantageously have planar work surfaces. The mounting block 20 may be a rectangular parallelopiped having a plurality of planar faces, on each of which may be mounted a sharpening stone.

The dart sharpening apparatus 10 also includes a means for simultaneously translating and rotating a dart to be sharpened across the sharpening stone 18. The means includes a dart holder 30, which will be shown more clearly in later figures. For present purposes, it should be noted that the dart holder 30 includes a toothed element 32, which brings about the rotation of the dart holder 30, and a dart 34 held thereby, as it is being translated across the sharpening stone 18.

The means for simultaneously translating and rotating the dart also includes a substantially rectangular frame 36 having a length substantially equal to that of the sharpening stone 18. The rectangular frame 36 includes two widthwise members 38 and two lengthwise members 40 defining a rectangular opening 42. The two widthwise members 38 have extensions 44 in a common direction. Extensions 44 are used to connect the rectangular frame 36 to the substantially U-shaped frame by directing a bolt 46 through one of the extensions 44, through one of the two opposed upright portions 16 of the substantially U-shaped frame 12, through the other upright portion 16, and through the other extension 44. A nut, not shown in FIG. 1, holds bolt 46 in place. Shims 48 may be used to occupy extra space, and to prevent rectangular frame 36 from moving longitudinally with respect to the sharpening stone 18.

Rectangular frame 36 is rotatable about bolt 46, so that dart 34 may first be loaded into dart holder 30, and subsequently brought into contact with sharpening stone 18 through rotation of the rectangular frame 36.

One of the two lengthwise members 40, preferably the one farther from bolt 46, is provided with a rack gear 50, which engages with toothed element 32 in dart holder 30.

Each lengthwise member 40 is provided with a guide rail 52 within rectangular opening 42. Dart holder 30 is disposed within a carrier 54, which has guide grooves 56, so that it may be translated within the rectangular opening 42 without slipping out through the cooperation of guide rails 52 and guide grooves 56. Carrier 54 may be made of a different metal from lengthwise members 40 and dart holder 30 to minimize wear.

A rod 58 is directed through widthwise member 38 and threadingly engages within carrier 54. A knob 60 is provided at the end of rod 58, so that it may be pulled in the manner suggested by the phantom hand, rod and knob in FIG. 1 to translate dart 34 across sharpening stone 18, which action also causes it to be simultaneously rotated, as indicated by the phantom dart in FIG. 1, through the cooperation between rack gear 50 and toothed element 32 on dart holder 30. It should be observed that because rack gear 50 is on lengthwise member 40 farthest away from bolt 46, or from extensions 44, the dart 34 rotates against the sharpening stone 18 in a direction opposite to that in which it is translated.

Figure 2:
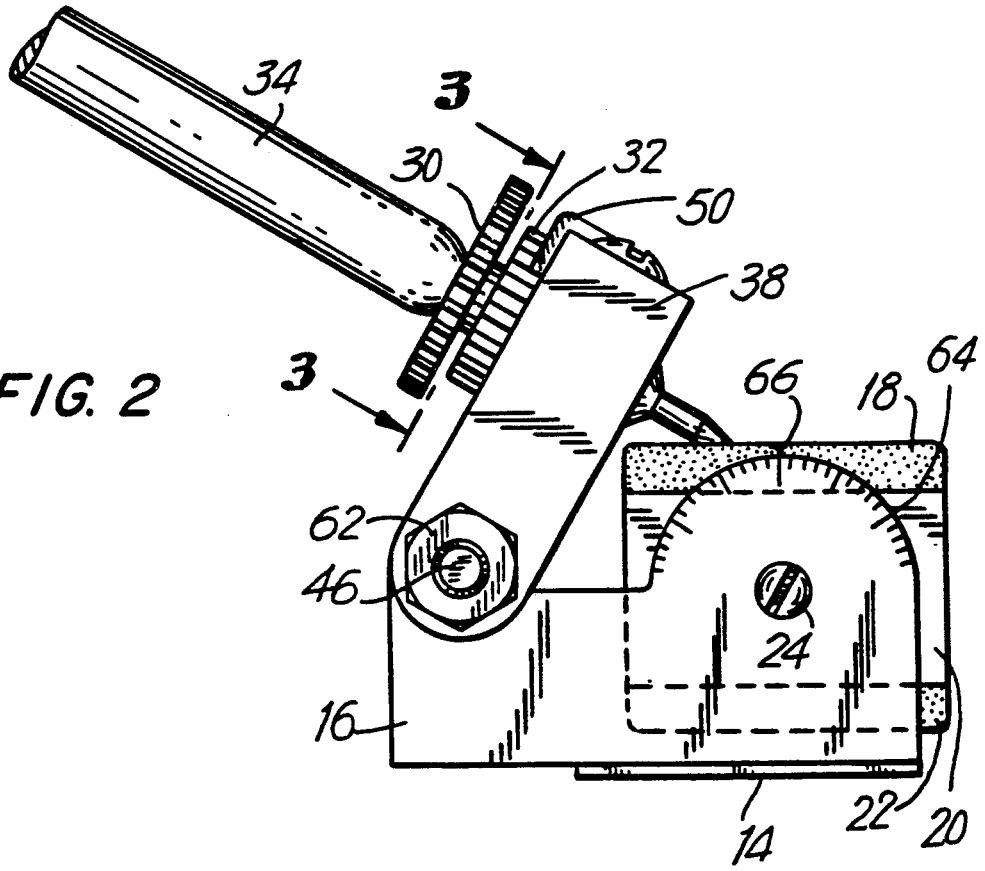
FIGS. 2 is a side view of the dart sharpening apparatus taken as indicated by line 2—2 in FIG. 1.

FIG. 2 is a side view of the dart sharpening apparatus 10 taken as indicated by line 2—2 in FIG. 1. There, it may be observed that nut 62, not visible in FIG. 1, is tightened onto bolt 46 to secure widthwise member 38 of rectangular frame 36 to upright portion 16 of substantially U-shaped frame 12. In addition, upright portion 16 may be provided with an angular reference scale 64, and sharpening stone 18 with a reference mark 66, so that sharpening stone 18 may be reproducibly set to a predetermined angular orientation to provide dart 34 with a point having a desired acuteness or sharpness.

Bolt 24, which passes axially through mounting block 20, and about which mounting block 20 may be rotated, is also visible in FIG. 2.

Figure 3:
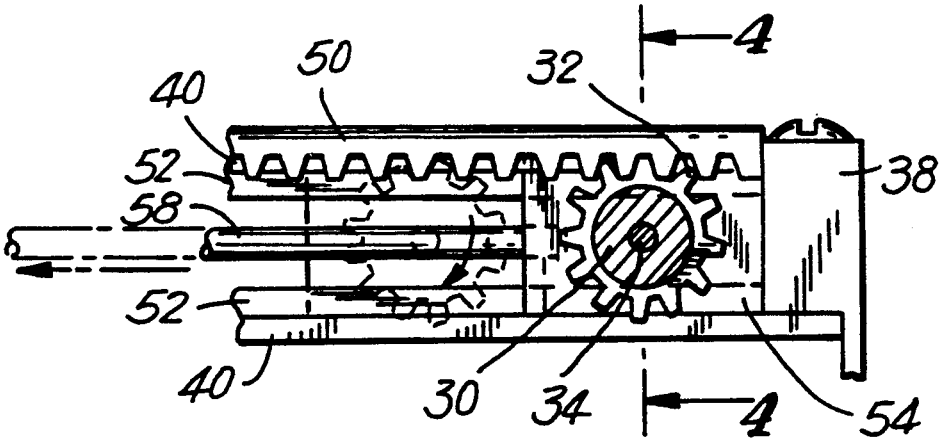
FIG. 3 is a cross-sectional view of the dart sharpening apparatus taken as indicated by line 3—3 in FIG. 3.

FIG. 3 is a cross-sectional view of the dart sharpening apparatus 10 taken as indicated by line 3—3 in FIG. 2. As may be observed, rack gear 50 on lengthwise member 40 causes dart holder 30 to rotate by reason of the toothed element 32 thereon, as rod 58 pulls carrier 54. As shown in the figure, toothed element 32 rotates the dart 30 in a clockwise sense as rod 58 pulls carrier 54 to the left.

FIG. 4 is a cross-sectional view of the dart sharpening apparatus 10 taken as indicated by line 4—4 in FIG. 3, and shows the dart holder 30 in better detail. The dart holder 30 comprises a cylindrical shaft 68 with an axial bore 70, and a diameter substantially equal to that of the hole in carrier 54 in which it is disposed. The cylindrical shaft 68 further has a diameter greater than the distance separating the guide rails 52 on lengthwise members 40. The outer surface of the cylindrical shaft is provided with a groove 72, so that guide rails 52 may hold the cylindrical shaft 68 within the carrier 54.

Toothed elements 32 are a rim of the cylindrical shaft 68 and cooperate with rack gear 50 to rotate dart holder 30. Within axial bore 70 is a resilient, compressible member 74, such as a rubber tube. Threaded end cap 76, when threadingly engaged within axial bore 70, compresses member 74 to effectively narrow its interior so that the shaft of a dart 34 may be firmly gripped when inserted therethrough.

Figure 6:
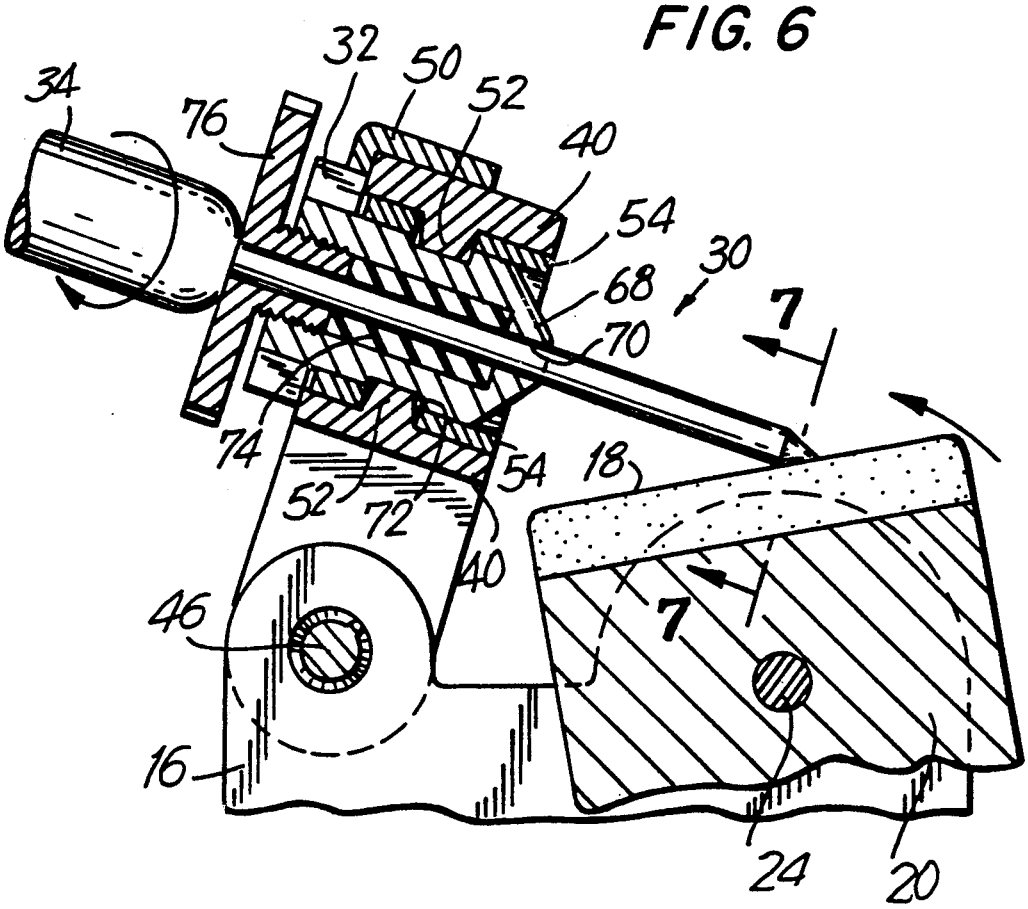
FIG. 6 is a cross-sectional view analogous to that provided in FIGS. 4 and 5, but wherein the sharpening stone has been set to a different angular orientation with respect to the dart shaft.

For purposes of comparison, FIGS. 5 and 6 illustrate how points of desired acuteness or sharpness may be put on dart 34 by adjusting the angular position of mounting block 20 and sharpening stone 18. The two have been turned to a position in FIG. 6 to provide a blunter point than would be provided by the setting shown in FIG. 5.

Figure 7:
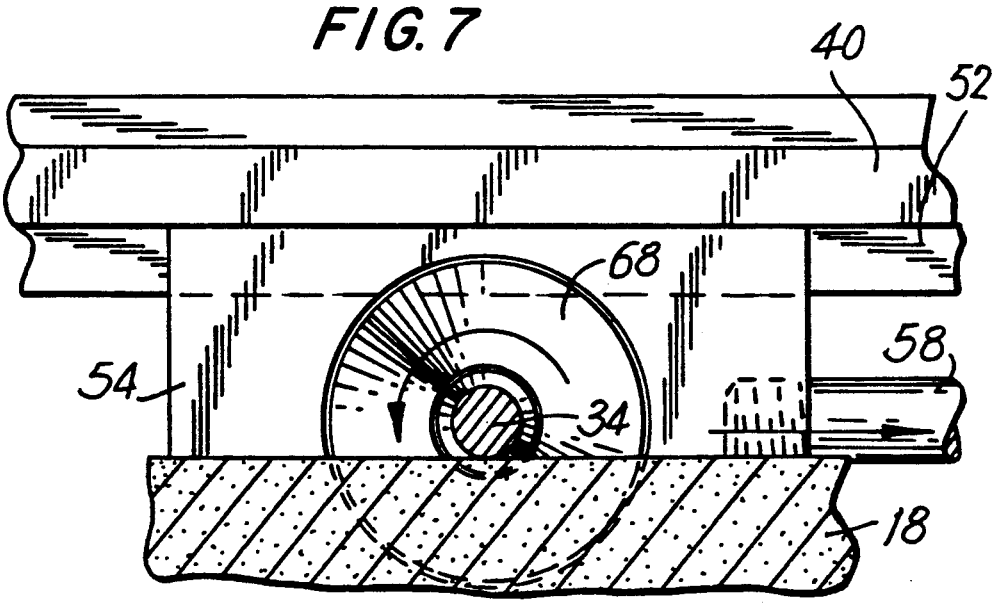
FIG. 7 is a cross-sectional view of the dart sharpening apparatus taken as indicated by line 7—7 in FIG. 6.

FIG. 7 is a cross-sectional view of the dart sharpening apparatus 10 taken as indicated by line 7-7 in FIG. 6. Dart 34, while being translated across sharpening stone 18 by rod 58 is rotated against the direction of translation to increase the grinding action against the sharpening stone 18.

Modifications to the present dart sharpening apparatus 10 would be obvious to those skilled in the art, but would not bring the apparatus so modified beyond the scope of the appended claims.

What is claimed is:

1. A dart sharpening apparatus comprising:

a substantially U-shaped frame having a bottom portion and two opposed upright portions;

a sharpening stone, said sharpening stone being disposed between said opposed upright portions of said substantially U-shaped frame;

means for disposing said sharpening stone between said opposed upright portions of said substantially U-shaped frame;

means for simultaneously translating and rotating a dart to be sharpened across said sharpening stone between said opposed upright portions of said substantially U-shaped frame, said means including a dart holder wherein the dart to be sharpened may be fixedly secured, said means being disposed between said opposed upright portions of said substantially U-shaped frame and being rotatable about an axis adjacent and substantially parallel to said sharpening stone, so that the dart may first be secured within said dart holder, and, subsequently, by rotating said means for simultaneously translating and rotating the dart about said axis, the dart may be brought into contact with said sharpening stone for sharpening;

wherein said means for simultaneously translating and rotating a dart to be sharpened across said sharpening stone comprises:

a substantially rectangular frame having a length substantially equal to that of said sharpening stone, said rectangular frame including two widthwise members and two lengthwise members defining a rectangular opening, said two widthwise members having extensions in a common direction, said extensions being used to connect said rectangular frame to said substantially U-shaped frame by directing a bolt through one of said extensions, through one of said opposed upright portions of said substantially U-shaped frame, through the other of said opposed upright portions, and through the other of said extensions, and by placing a nut upon said bolt, said rectangular frame thereby being rotatable about said bolt and affixed to said substantially U-shaped frame, said lengthwise members of said rectangular frame each having a guide rail within said rectangular opening and one of said lengthwise members having a rack gear attached thereto;

a carrier, said carrier being disposed within said rectangular opening and translatable back-and-forth lengthwise therewithin, said carrier having guide grooves on two opposed surfaces, said guide grooves cooperating with said guide rails on said lengthwise members to maintain said carrier within said rectangular opening, said carrier having a cylindrical hole directed therethrough, said cylindrical hole having a diameter greater than the distance separating said guide rails, so that said guide rails, cooperating with said guide grooves, may extend into said cylindrical hole through said carrier;

a rod, said rod having a first end, said first end having an enlarged knob, said rod being directed and extending through one of two widthwise members of said rectangular frame, said rod further having a second end, said second end threadingly engaging within a hole in said carrier, so that said rod may be used to translate said carrier back-and-forth within said rectangular opening; and a dart holder, said dart holder including a cylindrical shaft having an axial bore, said cylindrical shaft having a diameter substantially equal to that of said cylindrical hole in said carrier, said cylindrical shaft having a groove on an outer surface, so that said guide rails of said lengthwise members of said rectangular frame may hold said cylindrical shaft within said cylindrical hole in said carrier, said cylindrical shaft further having a threaded internal opening for said axial bore and a toothed external flange, so that said rack gear on one of two said lengthwise members of said rectangular frame may rotate said cylindrical shaft when said carrier is translated within said rectangular opening, said dart holder further including a resilient, compressible member within said axial bore of said cylindrical shaft and a threaded end cap, said threaded end cap being screwed into said threaded internal opening of said axial bore to compress said resilient, compressible member therewithin to narrow said axial bore, said end cap having a central hole, so that a dart may be inserted therethrough, and through said axial bore in said cylindrical shaft to be firmly held by said resilient, compressible member for sharpening against said sharpening stone.

2. A dart sharpening apparatus as claimed in claim 1 wherein said sharpening stone is a diamond stone.

3. A dart sharpening apparatus as claimed in claim 1 wherein said sharpening stone is a honing stone.

4. A dart sharpening apparatus as claimed in claim 1 wherein said sharpening stone has a plane surface.

5. A dart sharpening apparatus as claimed in claim 1 wherein said means for disposing said sharpening stone between said opposed upright portions of said substantially U-shaped frame is a mounting block, upon which said sharpening stone is fastened, said mounting block extending between said opposed upright portions of said substantially U-shaped frame and affixed thereto.

6. A dart sharpening apparatus as claimed in claim 5 wherein said mounting block is wooden.

7. A dart sharpening apparatus as claimed in claim 5 wherein said mounting block has a plurality of faces upon which said sharpening stone may be mounted.

8. A dart sharpening apparatus as claimed in claim 7 further comprising a second sharpening stone, said second sharpening stone being mounted on one of said plurality of faces of said mounting block unoccupied by another sharpening stone.

9. A dart sharpening apparatus as claimed in claim 5 further comprising a bolt and a threaded knob, said bolt extending through one of said opposed upright portions of said substantially U-shaped frame, axially through said mounting block, and through the other of said opposed upright portions of said substantially U-shaped frame, and said threaded knob being tightened upon said bolt, so that said mounting block and said sharpening stone may be affixed between said opposed upright portions of said U-shaped frame at a predetermined angular orientation with respect to said means for simultaneously translating and rotating said dart to be sharpened.

10. A dart sharpening apparatus as claimed in claim 9 wherein one of said opposed upright portions of said substantially U-shaped frame has an angular scale, and one of said mounting block and said sharpening stone has a reference mark, so that said mounting block and said sharpening stone may be set at a reproducible predetermined angular orientation with respect to said means for simultaneously translating and rotating said dart to be sharpened.

11. A dart sharpening apparatus as claimed in claim 11 wherein said rack gear is attached to said lengthwise member of said rectangular frame opposite said extensions of said widthwise members, and farthest from said bolt, so that, when said carrier is translated within said rectangular opening, said cylindrical shaft may be rotated in an opposed direction, so that said dart may be rotated against said sharpening stone in a direction opposite to that in which it is being translated.

* * * * *